US011293692B2

(12) United States Patent
Ulrich

(10) Patent No.: US 11,293,692 B2
(45) Date of Patent: Apr. 5, 2022

(54) METHOD AND DEVICE FOR DRYING AN EXPLOSIVE

(71) Applicant: RHEINMETALL WAFFE MUNITION GMBH, Unterluess (DE)

(72) Inventor: Thomas Ulrich, Kenzingen (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 149 days.

(21) Appl. No.: 16/533,337

(22) Filed: Aug. 6, 2019

(65) Prior Publication Data

US 2020/0141643 A1 May 7, 2020

Related U.S. Application Data

(63) Continuation of application No. PCT/EP2018/051857, filed on Jan. 25, 2018.

(30) Foreign Application Priority Data

Feb. 6, 2017 (DE) ..... 10 2017 102 271.6

(51) Int. Cl.
*F26B 3/347* (2006.01)
*C06B 21/00* (2006.01)
(Continued)

(52) U.S. Cl.
CPC ..... *F26B 3/347* (2013.01); *C06B 21/0091* (2013.01); *B28B 11/241* (2013.01);
(Continued)

(58) Field of Classification Search
CPC ..... F26B 3/347; F26B 15/18; C06B 21/0091; B28B 11/241; H05B 6/78; H05B 6/80; H05B 2206/04
See application file for complete search history.

(56) References Cited

U.S. PATENT DOCUMENTS 3,478,900 A * 11/1969 Jeppson ..... H05B 6/782 219/684
4,045,639 A * 8/1977 Meisel ..... F26B 5/041 219/700
(Continued)

FOREIGN PATENT DOCUMENTS

CN 101221009 A 7/2008
CN 101358803 A 2/2009
(Continued)

OTHER PUBLICATIONS

Translation of CN 106277728 A, Jan. 2017, Dai Changhong (Year: 2017).*
(Continued)

*Primary Examiner* — Jessica Yuen
(74) *Attorney, Agent, or Firm* — Muncy, Geissler, Olds & Lowe, P.C.

(57) ABSTRACT

A method and a device for drying an explosive, wherein the explosive contains moisture and microwave radiation causes the explosive to expel the moisture contained in the explosive. Provided is a drying chamber having magnetrons that exert the required microwave radiation on the explosive to be dried and thereby heat the explosive. During heating, the moisture in the explosive is then expelled.

9 Claims, 1 Drawing Sheet

(51) Int. Cl.

| | |
|---|---|
| ***B28B 11/24*** | (2006.01) |
| ***F26B 15/18*** | (2006.01) |
| ***H05B 6/78*** | (2006.01) |
| ***H05B 6/80*** | (2006.01) |

(52) U.S. Cl.
CPC ..... *F26B 15/18* (2013.01); *H05B 6/78* (2013.01); *H05B 6/80* (2013.01); *H05B 2206/04* (2013.01)

(56) References Cited

U.S. PATENT DOCUMENTS

| | | | | |
|---|---|---|---|---|
| 4,103,431 | A * | 8/1978 | Levinson | F26B 3/347 219/712 |
| 4,104,804 | A | 8/1978 | Sargeant | |
| 4,330,946 | A * | 5/1982 | Courneya | F26B 23/002 34/263 |
| 4,758,287 | A | 7/1988 | Pietz | |
| 4,979,315 | A | 12/1990 | Pierson | |
| 5,276,924 | A * | 1/1994 | Hachima | A47K 11/02 4/111.1 |
| 8,236,113 | B2 | 8/2012 | Becker et al. | |
| 9,585,419 | B2 * | 3/2017 | Stromotich | A23B 4/01 |
| 2001/0052192 | A1 * | 12/2001 | Turatti | F26B 5/12 34/201 |
| 2008/0136062 | A1 | 6/2008 | Kasai et al. | |
| 2011/0179701 | A1 * | 7/2011 | Grassi | C10L 5/442 44/606 |
| 2017/0115057 | A1 * | 4/2017 | Durance | F26B 5/048 |

FOREIGN PATENT DOCUMENTS

| | | | | |
|---|---|---|---|---|
| CN | 201382658 | Y | | 1/2010 |
| CN | 103923670 | A | | 7/2014 |
| CN | 205482180 | U | | 8/2016 |
| CN | 106277728 | A | * | 1/2017 |
| DE | 1113889 | B | | 9/1961 |
| DE | 3238648 | C1 | | 2/1984 |
| DE | 3509215 | A1 | | 9/1986 |
| DE | 3623511 | A1 | | 1/1988 |
| DE | 3820443 | A1 | | 12/1988 |
| DE | 3926434 | A1 | | 3/1990 |
| DE | 102010042865 | A1 | | 5/2011 |
| EP | 1835249 | A1 | | 9/2007 |
| EP | 1992675 | A1 | | 11/2008 |
| JP | 2824769 | B2 | | 11/1998 |
| KR | 20070082719 | A | | 8/2007 |

OTHER PUBLICATIONS

International Search Report dated Feb. 28, 2018 in corresponding application PCT/EP2018/051857.

Yu Weifei et al: "Effect of microwave irradiation on TATB explosive," Journal of Hazardous Materials, 2009, pp. 952-954, vol. 168, Elsevier.

* cited by examiner

METHOD AND DEVICE FOR DRYING AN EXPLOSIVE

This nonprovisional application is a continuation of International Application No. PCT/EP2018/051857, which was filed on Jan. 25, 2018, and which claims priority to German Patent Application No. 10 2017 102 271.6, which was filed in Germany on Feb. 6, 2017, and which are both herein incorporated by reference.

BACKGROUND OF THE INVENTION

Field of the Invention

The present invention relates to a method and a device for drying an explosive. Explosives in the meaning of the present invention can be solid and liquid materials and material mixtures which, upon sufficient energetic activation, undergo a specific strong chemical reaction, during which heat energy and gases develop. In particular, explosive materials, pyrotechnic charges, active charges, effect charges and also materials, raw materials and auxiliary materials, residual materials, and/or materials which can be used to produce explosives and pyrotechnic objects are contained in explosives.

Description of the Background Art

Explosives can contain a certain degree of moisture, wherein this moisture is not desired. The quality of the products produced from the explosives is thus decisively dependent on as little moisture as possible being present in the explosives. The storage life and the function which are produced from the explosives are dependent on as little moisture as possible being contained therein. Furthermore, there is increased phosphine formation from a specific moisture content in the case of specific explosives, for example, smoke charges based on red phosphorus. This is to be prevented, since phosphine is not desired in the explosive and is moreover highly toxic.

To expel the moisture present in the explosives, these materials are introduced for this purpose into a furnace, wherein greatly varying types of operating modes of the furnace are known for this purpose. Thus, for example, drying by thermal radiation, by convection, or by vacuum drying are known.

For example, DE 32 38 648 C1 describes one possible drying of such explosives. In this case, pyrotechnic material is guided through this process by one of the above-mentioned options for heating air to accordingly heat the pyrotechnic material in such a way that the moisture exits from the pyrotechnic material.

The time which is required for this drying is an essential factor in the processing of explosives. It is thus advantageous if the resulting drying time is shorter, since then more material can be processed in the same time.

SUMMARY OF THE INVENTION

It is therefore an object of the present invention to provide a drying method for an explosive, which functions faster than conventional methods and is linked to the lowest possible energy consumption. A lower energy consumption makes the method and/or the process more cost-effective.

Thus, firstly a method for drying an explosive is proposed, in which the explosive contains a certain degree of moisture. Instead of applying one of the conventional methods for drying and/or heating the explosive, the present invention now proposes subjecting the material to microwave radiation, however, whereby the explosive and the moisture are heated. The moisture is expelled from the material by this heating, for example, by evaporation.

Microwaves have therefore proven themselves to be advantageous because they have a lower energy consumption than conventional furnaces and the time in which the explosive is subjected to the microwave radiation until a sufficiently greater degree of dryness is achieved is relatively short in relation to conventional furnaces. The heating by microwaves takes place more rapidly than in convection heat or radiant heat.

The method and the device are not restricted to only one explosive, but rather any arbitrary compositions can be dried as an explosive.

In an embodiment, a support device is provided, on which the explosive which is to be dried is applied. This support device promotes the drying in multiple ways. Either the support device itself can be heated, which assists the drying process, or the support device is made reflective in relation to microwave radiation, so that the microwave radiation acting on the explosive to be dried first penetrates through the material, is reflected from the support device, and then penetrates through the material to be dried once again. An acceleration of the drying once again is thus possible by way of the design of the support device. The support device can moreover also be designed as radiation-transparent, so that microwaves can act on the explosive from various directions, also from below the support device.

According to the method, there should be sufficient space above the explosive to be dried so that the moisture can be expelled upon heating of the explosive, and/or can be evaporated. In this case, the moisture then rises in a corresponding expulsion direction out of the materials, namely upward, as is expected of water vapor.

In addition to the method, a device for drying explosives is also proposed by the present invention, wherein again an explosive to which moisture is applied is to be dried, wherein the device contains a drying chamber in which the material can be dried. Furthermore, the device has a support device, similar to the above-mentioned support device of the method, on which the material can be stored.

At least one magnetron is now associated with the drying chamber, which can generate microwave radiation in the direction of the support device and thus in the direction of the materials to be dried. Multiple magnetrons can also be provided, also associated with different action directions of the drying chamber depending on the equipment of the support device. The magnetrons can thus be arranged so that microwave radiation can act from multiple directions on the explosive to be dried.

If the support device is designed as reflective, it is proposed that the magnetrons only be arranged above or laterally to the drying chamber, so that the microwave radiation emitted by the magnetrons is primarily incident on the explosive from above. However, the support device is possibly also designed as transparent to microwave radiation. In this case, the magnetrons can also act from all directions on the material to be dried, in particular also from below. The microwave radiation emitted from below would then radiate through the support device and then be incident on the material to be dried.

In an embodiment, it is proposed that at least one sensor is associated with the drying chamber to detect the state inside the drying chamber. These sensors can preferably measure moisture and/or measure temperatures. The state inside the chamber is then simpler to assess and it is also simpler to determine when a sufficiently high level of drying has taken place on the basis of these measurement results.

The support device is embodied as a transportation belt in a particular embodiment of the device, so that the explosive to be dried can be guided through the drying chamber. For this purpose, the transportation belt has a transportation direction and a transportation speed. The explosive to be dried is thus guided through the drying chamber on the transportation belt and the speed of the transportation belt is then set so that the material has a sufficiently high level of dryness as it moves out of the drying chamber.

Furthermore, in an embodiment, a first chamber is provided, which is upstream of the drying chamber. The transportation belt thus moves the explosive first through the first chamber and then into the drying chamber. It is also proposed that a second chamber be downstream of the drying chamber, so that the transportation belt then guides the material which is guided out of the drying chamber through a second chamber. It is possible by way of these embodiments to prepare the explosive accordingly before the drying or post-process it after the drying, respectively.

It is thus conceivable to preheat the explosive in the first chamber, either by further microwave radiations or by conventional heat. Heating elements are then provided in the first chamber. It is also possible to cool the explosive moving out of the drying chamber in the second chamber, to subsequently be able to use it directly. To be able to cool the material in the second chamber, cooling elements are provided according to the invention. These cooling elements can be simple fans or also climate control elements, which cool down the entire second chamber.

The first and/or the second chamber can also subject the explosive to be dried to adsorption. In this case, the surface area of the material is changed to optimize the microwave drying and minimize the risk that the explosive will ignite.

The conveyor belt speed can be varied depending on the material or material quantity to be dried. It is always possible to achieve an optimum drying result by way of this variation.

It is also possible to set the wavelength and/or the power of the magnetrons. By way of the setting of the wavelength, it is possible to ensure the optimum introduction of heat intentionally for a specific explosive, since different materials induce different levels of heat generation due to different wavelengths. By setting the power, it is possible to ensure a drying profile if, for example, as the material is moved through on the transportation belt in the drying chamber, the power is regulated up or down in accordance with the already achieved heat.

In order that the expelled moisture does not remain inside the drying chamber and obstruct the further escape of moisture, it is provided in a further embodiment that fans are associated with the drying chamber, which transport the air inside the drying chamber to outside the drying chamber. These fans can optionally also have moisture filters if the moisture is to be collected.

It is proposed that the individual chambers be provided with air for the sake of simplicity. However, it is also conceivable to fill the chamber and in particular the drying chamber with a gas other than air, for example to suppress possible reactions inside the explosive material to be dried due to the effect of heat.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
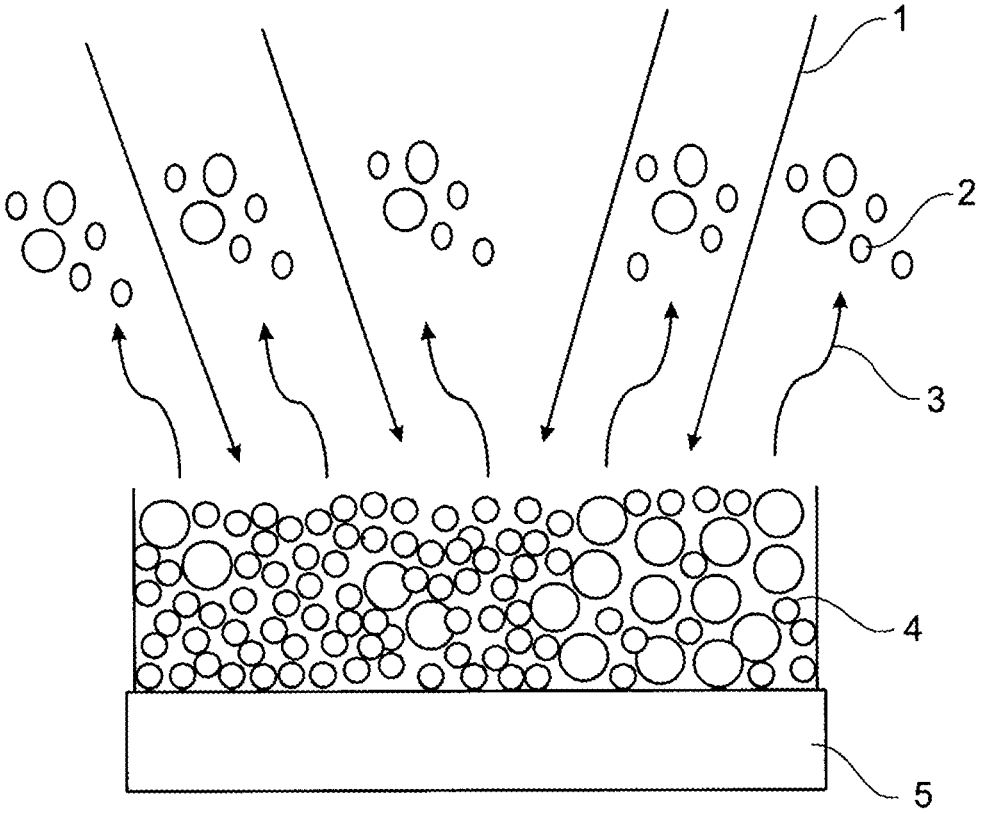
FIG. 1 shows a schematic illustration of the method according to the invention.

FIG. 1 shows the explosive 4 to be dried, which contains a certain degree of moisture 2, which is to be expelled from the explosive 4 by the drying procedure.

For this purpose, according to the invention, the explosive 4 is provided with a microwave radiation 1, which heats the explosive 4 and the moisture 2 contained therein. The moisture 2 is expelled from the explosive 4 by the heating, preferably by evaporation.

The explosive 4 to be dried is arranged on a support device 5 and the microwave radiation 1 is applied from above onto the explosive 4 to be dried. To accelerate the drying, the support device 5 can be made reflective for this purpose, so that the microwave radiation 1 firstly penetrates the explosive 4 to be dried, is reflected by the support device 5, and once again penetrates the explosive 4 to be dried.

Alternatively, it is also possible to make the support device 5 radiation-transparent, so that the microwave radiation 1 is not only incident from above on the explosive 4 to be dried, but rather also from below, for example. For this purpose, the microwave radiation 1 firstly penetrates the support device 5 and is then incident on the explosive 4 to be dried.

The explosive 4 to be dried is heated and the moisture 2 contained therein is also heated by the microwave radiation 1. This heating takes place in such a way that the moisture 2 is expelled from the explosive 4. This expulsion preferably takes place upward out of the explosive 4, specifically in the expulsion direction 3.

Figure 2:
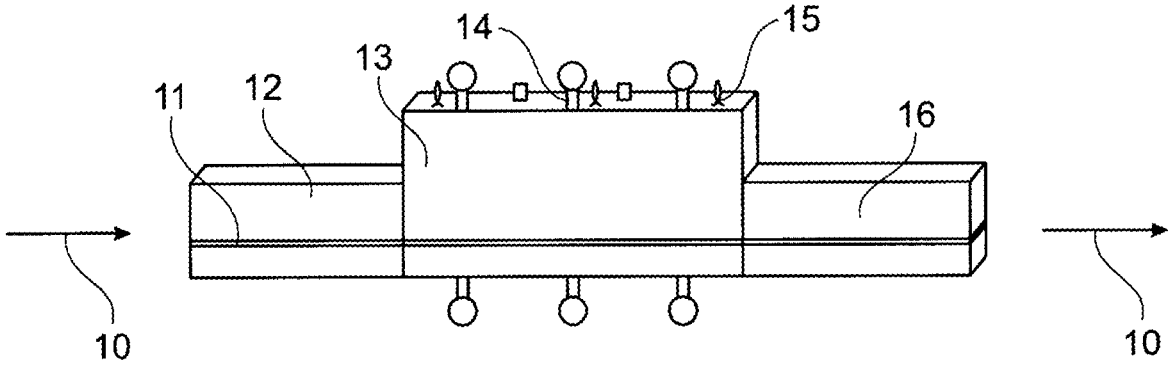
FIG. 2 shows a schematic illustration of the device according to the invention

The corresponding device for drying explosive 4 is shown in FIG. 2. A drying chamber 13 is shown in FIG. 2, as well as a first chamber 12 and a second chamber 16, which are upstream and downstream, respectively, of the drying chamber 13.

The support device 5 is implemented in this case by a transportation belt 11, which moves through the device according to the invention for drying explosive 4 in the transportation direction 10. For this purpose, the explosive 4 is firstly transported through the first chamber 12 by the transportation belt 11.

This first chamber 12 can be used to prepare the explosive 4 to be dried accordingly, before it enters the drying chamber 13. For this purpose, for example, the explosive 4 can be preheated by further magnetrons or by convection heat elements. However, it is also possible to provide an adsorption device for adsorption in the first chamber, to prepare the surface of the explosive 4 to be dried so that due to enrichment of materials on the surface of the solid of the explosive 4, it obtains better heat absorption by the microwave radiation 1 or obtains protection against ignition due to the microwave radiation 1.

After the explosive 4 to be dried has been transported through the first chamber 12, it enters the drying chamber 13 via the transportation belt 11. The drying chamber 13 is equipped with at least one magnetron 14, which can apply microwave radiation 1 to the explosive 4 to be dried.

The explosive 4 to be dried is heated by the microwave radiation 1 and the moisture 2 contained in the explosive 4 is expelled from the explosive 4 due to the heating.

To monitor the optimum expulsion of the moisture 2 from the explosive 4, it is proposed that the drying chamber 13 be equipped with at least one sensor 15 to be able to monitor the environment inside the drying chamber 13. This sensor or the multiple sensors can then monitor the temperature inside the drying chamber 13 or also the moisture 2 inside the drying chamber 13. To monitor the heat inside the drying chamber 13, it is proposed that at least one pyrometer be used as a sensor 15 to limit the temperature measurement to the thermal radiation.

After the explosive 4 to be dried has been transported through the drying chamber 13 on the transportation belt 11, it enters the second chamber 16. This chamber can be used for postprocessing of the explosive 4 to be dried. For this purpose, it can contain cooling elements, for example, to cool down the explosive 4 to be dried to temperatures which permit further processing. However, at least one further adsorber could also be provided, which once again processes the surface of the explosive 4 to be dried for further use.

The running speed of the transportation belt 11 is variable for this purpose to adapt the drying procedure and the dwell time in the drying chamber 13 to the respective explosive 4 to be dried and/or the material thickness. The wavelength of the magnetron 14 is also variable to also ensure an adaptation to the explosive 4 to be dried here. An optimum adaptation to any arbitrary explosive 4 to be dried is ensured by this variability.

In order that the damp air is transported out of the drying chamber 13, a fan (not shown) is preferably provided, which guides the air out of the drying chamber 13. This fan can optionally contain a moisture filter, if it is not desirable for the moisture 2 to reach the outside.

The present invention is not restricted to the above-mentioned features, rather, further designs are conceivable. It is thus conceivable, for example, to provide field monitoring in the drying chamber, which checks the homogeneity of the microwave radiation. For this purpose, corresponding sensors for field monitoring have to be associated with the drying chamber. Furthermore, it is conceivable to vary the power of the individual magnetrons via the path through the drying chamber, so that a drying profile results. Upon the introduction of the explosive to be dried into the drying chamber, firstly little energy is exerted until then the maximum required energy is exerted by the magnetron on the explosive to be dried up to the middle of the drying chamber and then less energy again during the transportation out. The heating of the explosive to be dried during the transportation through the drying chamber 13 can thus be optimized. Alternatively, a continuous homogeneous field can be used to ensure a continuous drying procedure.

Instead of a transportation belt, a filling or metering transportation system can also be used to ensure drying in batches. Finally, a mixture of multiple explosives can also be dried in one drying procedure.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for drying an explosive that contains moisture, the device comprising:

a drying chamber in which the explosive is dried;

a support device on which the explosive is stored;

at least one magnetron being associated with the drying chamber, via which the explosive is subjected to microwave radiation, wherein the support device is a transportation belt, which has a transportation direction, wherein a first chamber is provided and is positioned upstream of the drying chamber, wherein the transportation belt extends through the first chamber and the drying chamber so that the transportation belt guides the explosive through the first chamber and then through the drying chamber, wherein the first chamber includes further magnetrons so that a heating of the explosive in the first chamber is provided, and wherein an adsorption device, that subjects the explosive to adsorption, is provided in the first chamber.

2. The device as claimed in claim 1, wherein at least one sensor is associated with the drying chamber, which permits a moisture and/or temperature measurement.

3. The device as claimed in claim 1, wherein a second chamber is downstream of the drying chamber, and wherein the transportation belt extends through the second chamber so that the transportation belt guides the explosive through the second chamber after the drying chamber.

4. The device as claimed in claim 3, wherein cooling elements cool the explosive in the second chamber.

5. The device as claimed in claim 3, wherein an additional adsorption device is provided in the second chamber to subject the explosive to adsorption.

6. The device as claimed in claim 1, wherein a running speed of the transportation belt is variable.

7. The device as claimed in claim 1, wherein the wavelength of the at least one magnetron is variable.

8. The device as claimed in claim 1, wherein at least one fan is provided, which exhausts the air in the drying chamber to outside the drying chamber.

9. The device as claimed in claim 8, wherein the fan has at least one moisture filter.

* * * * *